United States Patent [19]

Masuda et al.

[11] Patent Number: 4,958,745

[45] Date of Patent: Sep. 25, 1990

[54] CONNECTOR TANK MEANS FOR CAP FOR MOUTH OF TANK

[75] Inventors: Isao Masuda, Tachikawa; Toshio Taomo, Tokyo; Fujio Sasaki, Mitaka, all of Japan

[73] Assignee: Kioritz Corporation, Yokyo, Japan

[21] Appl. No.: 70,873

[22] Filed: Jul. 2, 1987

Related U.S. Application Data

[63] Continuation of Ser. No. 848,855, Apr. 4, 1986, abandoned.

[30] Foreign Application Priority Data

Apr. 23, 1985 [JP] Japan ..... 60-60440

[51] Int. Cl.[5] ..... B65D 55/16

[52] U.S. Cl. ..... 220/375

[58] Field of Search ..... 220/375

[56] References Cited

U.S. PATENT DOCUMENTS

| | | | |
|---|---|---|---|
| 193,015 | 7/1877 | McCarthy | 220/375 |
| 733,438 | 7/1903 | Tatum | 220/375 |
| 876,504 | 1/1908 | Tabler | 220/375 |
| 1,543,256 | 6/1925 | Grant | 220/375 |
| 1,934,334 | 11/1933 | Schumann . | |
| 2,640,625 | 6/1953 | Blanchard | 220/375 |
| 4,193,575 | 3/1980 | Burgess | 220/375 |

FOREIGN PATENT DOCUMENTS

| | | | |
|---|---|---|---|
| 8510994 | 8/1985 | Fed. Rep. of Germany . | |
| 1253868 | 1/1961 | France | 220/375 |
| 177473 | 4/1922 | United Kingdom . | |

*Primary Examiner*—George E. Lowrance

*Attorney, Agent, or Firm*—Brody and Neimark

[57] ABSTRACT

A connector for a cap applied to a mouth of a tank including an engaging member having an annular portion formed of elastic material connected to one end of an elongated portion, and a plurality of beam-like portions formed integrally with the annular portion and arranged substantially in the form of a letter V in the annular portion.

1 Claim, 2 Drawing Sheets

CONNECTOR TANK MEANS FOR CAP FOR MOUTH OF TANK

This application is a continuation of application Ser. No. 848,855 filed Apr. 4, 1986.

BACKGROUND OF THE INVENTION (1) Field of the Invention

This invention relates to connector means for a cap for the mouth of a tank.

(2) Description of the Prior Art

A cap for closing the mouth of a tank is liable to be stained or damaged. One type of connector means known in the art for avoiding this problem comprises an elongated member, such as a string or chain, secured at one end to the inner side of the cap and extending at an opposite end through the mouth into the interior of the tank, and an engaging member of a diameter greater than that of the mouth of the tank secured to the opposite end of the elongated member and brought into engagement with the inner side of the mouth.

The connector means of this construction of the prior art has suffered disadvantages. Difficulty has been encountered in inserting the engaging member into the tank. The engaging member has often tended to be easily dislodged through the mouth from the interior of the tank, blocking the flow of a fluid through the mouth. The tank has often been damaged by the engaging member's during inserted therein.

SUMMARY OF THE INVENTION (1) Object of the Invention

This invention has been developed for the purpose of obviating the aforesaid disadvantages of the prior art. Accordingly, the invention has as its object the provision of connector means for a cap to be applied to the mouth of a tank which is simple in construction, easy to produce and trouble-free in handling.

(2) Statement of the Invention

The outstanding characteristic of the invention is that the engaging member comprises an annular portion formed of elastic material connected to one end of an elongated portion, and beam-like portions substantially in the form of a letter V formed integrally with the annular portion and located in the annular portion.

The connector means according to the invention including the aforesaid feature offers the following advantages. The annular member is readily bent along the beam-like portions of the V-shape to facilitate its insertion into the tank through its mouth. After being inserted into the tank, the annular member is readily restored to its original shape by virtue of its resilience. As a force is exerted on the connector means to pull it outwardly of the tank, the annular portion is brought into engagement, at points near the V-shaped beam-like portions join the annular portion, with the end of the inner side of the mouth of the tank, so that the V-shaped beam-like portions exerts a reaction to the force exerted on the connector means to pull it outwardly. This renders the annular portion difficult to be deformed, to thereby positively hole the annular portion in the tank.

In inserting the connector means according to the invention for the cap for the mouth of the tank, no force of high magnitude is required. After being inserted into the tank, the connector means according to the invention is positively prevented from being dislodged through the mouth of the tank. Also, the connector means causes no damage to the tank and does not block the flow of a fluid through the mouth.

DESCRIPTION OF THE PREFERRED EMBODIMENT

Figure 1:
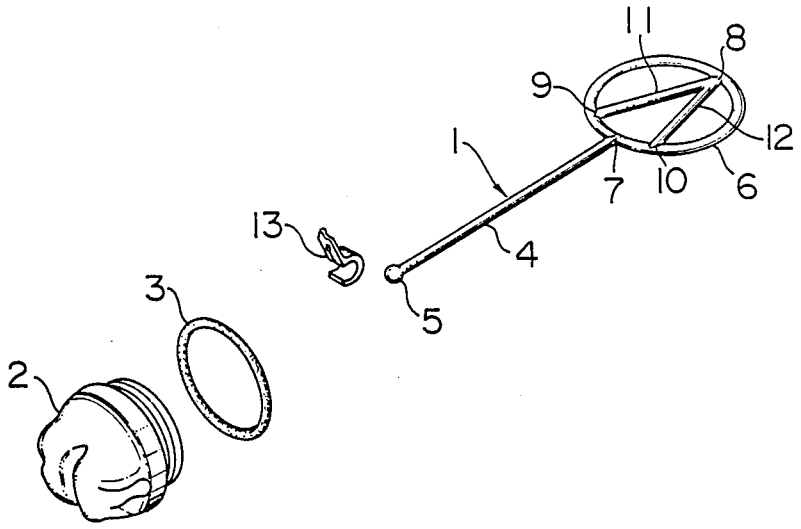
FIG. 1 is an exploded perspective view of a cap for the mouth of a tank having attached thereto the connector means comprising one embodiment of the invention.

FIG. 1 is an exploded perspective view of a cap 2 for a mouth of a tank (not shown) having connector means according to the invention generally designated by the reference numeral 1. The cap 2 is threadably applied to the mouth of a tank with an O-ring 3.

Figure 2A:
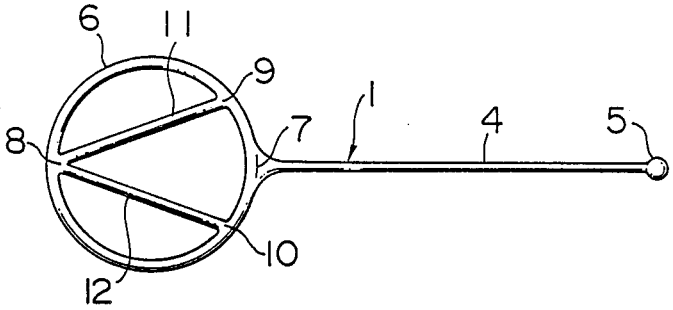
FIG. 2A is a plan view of the connector means shown in FIG. 1.
Figure 2B:
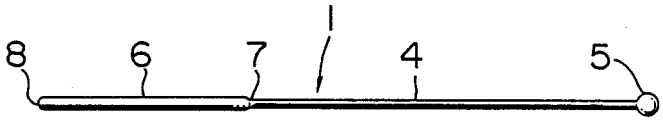
FIG. 2B is a side view of the connector means shown in FIG. 2A.

The connector means 1 is formed as a unitary structure of synthetic resinous material having elasticity, such as nylon, and comprises, as clearly shown in FIGS. 2A and 2B, an elongated portion 4, a spherical portion 5 located at one end of the elongated portion 4 and an annular portion 6 located at an opposite end of the elongated portion 4. The annular portion 6 is joined to the elongated portion 4 at a point 7 and has two beam-like portions 11 and 12 extending from a point 8 located in a position diametrically opposed to that of the point 7 to points 9 and 10, respectively, located at the annular portion 6, so that the beam-like portions 11 and 12 are substantially in the form of a letter V.

Figure 3B:
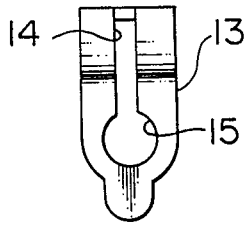
FIG. 3B is a front view of the coupler shown in FIG. 3A.
Figure 3A:
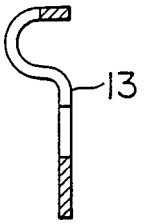
FIG. 3A is a sectional side view of a coupler for coupling the connector means to the cap.

A coupler 13 shown in FIGS. 3A and 3B is secured to the inner side of the cap 2 and formed of a metal strip having a curved upper portion and a planar lower portion having a nipple-like projection at its end. The upper portion of the coupler 13 is curved as shown in FIG. 3A, and the coupler 13 is formed with a slit 14 extending substantially in a central portion through substantially its entire length. The slit 14 ends in a circular opening 15 formed in the planar lower portion of the coupler 13 and has a width which is large enough to allow the elongated portion 4 of the connector means 1 to extend therethrough without any trouble, and the circular opening 15 has a slightly greater diameter than the spherical portion 5 at the one end of the elongated portion 4.

Before securing the coupler 13 to the inner side of the cap 2, the spherical portion 5 at the one end of the elongated portion 4 is passed through the circular opening 15 from left to right as seen in FIG. 3A, and then positioned against the inner side of the curved upper portion of the coupler 13. At this time, the elongated portion 4 extends through the slit 14 leftwardly as seen in FIG. 3A. With the spherical portion 5 being positioned against the inner side of the curved upper portion of the coupler 13, the coupler 13 is brought into contact at its right side as seen in FIG. 3A with the inner side of the cap 2 and secured to the cap 2 by a screw (not shown) extending through the circular opening 15. Thus, the connector means is connected at one end thereof to the inner side of the cap 2 for rotation and prevented from being dislodged from the cap 2.

Meanwhile, the annular portion 6 of the connector means 1 is readily inserted into the tank through its mouth as the annular portion 6 is bent along the beam-like portions 11 and 12 in the form of an arrow. After being inserted into the tank, the annular portion 6 is restored from the arrow-like shape to its original shape by virtue of the resilience of its material.

As the cap 2 is removed from the mouth of the tank, the connector means 1 is urged to move outwardly of the mouth of the tank by the gravitational pull exerted on the cap 2 and the annular portion 6 is brought into contact at the points 9 and 10 or their vicinities with the end of the inner side of the mouth of the tank, so that the cap 2 is held in suspension near the mouth of the tank. Even if a force is exerted on the connector means 1 to move same further outwardly, the beam-like portions 11 and 12 offer resistance to such force to avoid deformation of the annular portion 6, whereby the connector means 1 can be prevented from being pulled through the mouth out of the tank.

What is claimed is:

1. Connector means formed as a unitary structure for a cap of a mouth of a tank comprising:

an elongated portion connected at one end thereof to the cap; and an engaging member connected to an opposite end of said elongated portion and located inside the tank for engagement with the inner side of the mouth of the tank;

wherein the improvement resides in that said engaging member comprises:

an annular portion formed of elastic material connected to the opposite end of said elongated portion; and a plurality of beam-like portions formed integrally with said annular portion and arranged substantially in the form of the letter V in said annular position, said annular portion being bendable along said beam-like portions in an arrow-like form only in a direction to be inserted into the mouth of said tank.

* * * * *